US012703953B2

(12) United States Patent
Stroyer

(10) Patent No.: US 12,703,953 B2
(45) Date of Patent: Aug. 11, 2026

(54) UNIVERSAL THREE-WAY ROUND PILE SQUARE PILE THREADED BAR COUPLER USABLE WITH A TIEBACK ANCHOR

(71) Applicant: Benjamin G. Stroyer, Webster, NY (US)

(72) Inventor: Benjamin G. Stroyer, Webster, NY (US)

( * ) Notice: Subject to any disclaimer, the term of this patent is extended or adjusted under 35 U.S.C. 154(b) by 110 days.

(21) Appl. No.: 18/927,359

(22) Filed: Oct. 25, 2024

(65) Prior Publication Data

US 2026/0117480 A1 Apr. 30, 2026

Related U.S. Application Data

(60) Provisional application No. 63/542,664, filed on Oct. 5, 2023.

(51) Int. Cl.
*E02D 5/80* (2006.01)
*E02D 5/52* (2006.01)
*E02D 29/02* (2006.01)

(52) U.S. Cl.
CPC ..... *E02D 5/526* (2013.01); *E02D 5/80* (2013.01); *E02D 29/0233* (2013.01); *E02D 2600/20* (2013.01); *E02D 2600/30* (2013.01)

(58) Field of Classification Search
CPC .. E02D 5/52; E02D 5/526; E02D 5/54; E02D 5/80; E02D 5/801; E02D 29/0233
See application file for complete search history.

(56) References Cited

U.S. PATENT DOCUMENTS 3,360,285 A * 12/1967 Huckshold ..... E21B 17/046 285/8
4,691,818 A * 9/1987 Weber ..... B65G 33/32 198/677
5,460,231 A 10/1995 Collins
(Continued)

FOREIGN PATENT DOCUMENTS

CN 108442368 A * 8/2018 ..... E02D 5/526
KR 200490229 Y1 * 10/2019 ..... E02D 5/56

OTHER PUBLICATIONS https://www.geoengineer.org/news/chance-introduces-new-universal-adapter-for-tieback-applications (Year: 2025).*
International Search Report PCT/2024/053043 (Jan. 24, 2025).

*Primary Examiner* — Frederick L Lagman
(74) *Attorney, Agent, or Firm* — Michael J. Nickerson

(57) ABSTRACT

A three-way round pile square pile threaded bar coupler includes a thread bar interface section and a pile interface section. The pile interface section includes a first pile interface configured to couple to a round cross-section type pile and a second pile interface configured to couple to a four-sided cross section type pile. The thread bar interface section includes a thread bar interface end having a thread bar opening configured to receive a thread bar and a thread bar nut chamber configured to prevent a thread bar nut from rotating. The pile interface section includes first pile openings configured to receive a bolt associated with a round cross-section type pile and second pile openings configured to receive a bolt associated with a round cross-section type pile. The pile interface section includes a four-sided cross section type pile opening and inner four-sided cross section type pile chamber.

11 Claims, 12 Drawing Sheets

(56) References Cited

U.S. PATENT DOCUMENTS

| | | | | |
|---|---|---|---|---|
| 7,722,286 | B2 * | 5/2010 | Heald | E01F 9/681 403/183 |
| 7,779,589 | B2 | 8/2010 | Salman | |
| 8,888,413 | B2 * | 11/2014 | Seider | E02D 5/56 405/250 |
| 10,294,623 | B2 | 5/2019 | Kaufman et al. | |
| 11,668,064 | B2 | 6/2023 | Waltz et al. | |
| 2009/0151302 | A1 | 6/2009 | Benford | |
| 2010/0143048 | A1 * | 6/2010 | Lin | E02D 5/801 405/244 |
| 2011/0194901 | A1 * | 8/2011 | Jones | E02D 5/801 405/252.1 |
| 2014/0270939 | A1 * | 9/2014 | Intagliata | E01F 9/629 404/9 |
| 2018/0155891 | A1 | 6/2018 | Kaufman et al. | |

* cited by examiner

UNIVERSAL THREE-WAY ROUND PILE SQUARE PILE THREADED BAR COUPLER USABLE WITH A TIEBACK ANCHOR

PRIORITY INFORMATION

The present application claims priority, under 35 U.S.C. § 119(e), from U.S. Provisional Patent Application Ser. No. 63/542,664, filed on Oct. 5, 2023. The entire content of U.S. Provisional Patent Application Ser. No. 63/542,664, filed on Oct. 5, 2023, is hereby incorporated by reference.

BACKGROUND

Conventionally, soldier pile and lagging walls are used to construct retention walls or retention systems during the foundation building process. Conventional retention systems have been used for deep excavations in a variety of situations such as slope stabilization, earth retention, and remediation.

FIG. 1 illustrates a conventional retention system. As illustrated in FIG. 1, a retention system includes a retention wall 10 constructed of soldier piles 20 and lagging planks 30 located between the soldier piles 20. The soldier piles 20 and lagging planks 30, via the lagging planks 30, are tied to a load zone, which is an area in the soil having the strength for the desired holding capacity, using lags. The lags are constructed of tiebacks (anchors) 80 and extension rods 85 (if necessary).

The lags are coupled to a thread bar 50, via a conventional square shaft helical pile adapter for a thread bar used as a tieback anchor 40. The adapter 40 and thread bar 50 are coupled to a non-tieback end of the lag while the non-tieback end of the lag is located on a non-soil side or front side of the retention wall 10. The lag and thread bar 50 are driven further into the soil or countersink the lag and thread bar 50 until only a predetermined length of the thread bar 50 is exposed on non-soil side or front side of the retention wall 10.

Once the lag and thread bar 50 are appropriately counter sunk, a tieback plate 60 is placed over the thread bar 50, and a nut 70 is screwed onto the thread bar 50. The nut 70 is tightened until the tieback plate 60 has an appropriate pressure on the retention wall 10.

FIG. 2 illustrates a conventional square shaft helical pile adapter for a thread bar used as a tieback anchor. As illustrated in FIG. 2, at one end of the adapter 40, a shaft opening 41 is located, to receive a square shaft helical pile (not shown). A nut and bolt system 43 is used to secure the square shaft helical pile (not shown) to the adapter 40.

At the other end of the adapter 40, a bar opening 45 is located, to receive a threaded bar (not shown). Additionally, a nut opening/chamber 49 is provided to enable the placement of a thread bar nut (not shown) within the adapter 40. The nut opening/chamber 49 includes a threaded bar nut recess 47 to transfer the rotational force being applied to the thread bar nut (not shown), from rotating the threaded bar, to the adapter 40, which, in turn, transfers the rotational force, being applied thereto, to the square shaft helical pile (not shown).

The conventional adapter 40 of FIG. 2 allows square shaft helical piles to be connected directly to thread bar or all thread rods. In the tieback application, the adapter 40 allows the attachment of the thread bar on the front side of the wall for countersinking the entire pile past the wall. Moreover, the adapter 40 enables the placement of a driver tool over the thread bar to enable the direct driving of the thread bar to complete installation of the pile. Builders have found that these systems are not only efficient but also cost effective as well.

However, piles are metal tubes having either a circular or a rectangular cross-section. Such piles are mounted in the ground to provide a support structure for the construction of superstructures. The piles are provided in sections that are driven into the ground.

Conventionally, a pile is driven (rotated) by a driver. The driver is connected to the pile using a pile coupler or adapter. The coupler or adapter includes a pile interface to connect (couple) to the pile.

As noted above, conventional piles have either a circular or a rectangular/square cross-section, and thus, a conventional pile coupler or adapter would be designed to have a pile interface to connect (couple) to a circular cross-section type pile or designed to have a pile interface to connect (couple) to a rectangular/square cross-section type pile.

In other words, conventionally, two types of couplers or adapters have been used to drive (rotate) piles: (1) a coupler or adapter with a circular pile interface; or (2) a coupler or adapter with a rectangular/square pile interface Therefore, it is desirable to provide a single pile coupler or adapter that includes both a pile interface to connect (couple) to a circular cross-section type pile and a pile interface to connect (couple) to a rectangular/square cross-section type pile.

Additionally, it is desirable to provide a pile adapter for a thread bar used as a tieback anchor that includes both a pile interface to connect (couple) to a circular cross-section type pile and a pile interface to connect (couple) to a rectangular/square cross-section type pile.

Also, it is desirable to provide a pile adapter for a thread bar used as a tieback anchor that includes both a pile interface to connect (couple) to a circular cross-section type pile and a pile interface to connect (couple) to a rectangular/square cross-section type pile and enables the driving of the pile into the medium by driving the thread bar.

BRIEF DESCRIPTION OF THE DRAWINGS

The drawings are only for purposes of illustrating various embodiments and are not to be construed as limiting, wherein.

DETAILED DESCRIPTION

Figure 1:
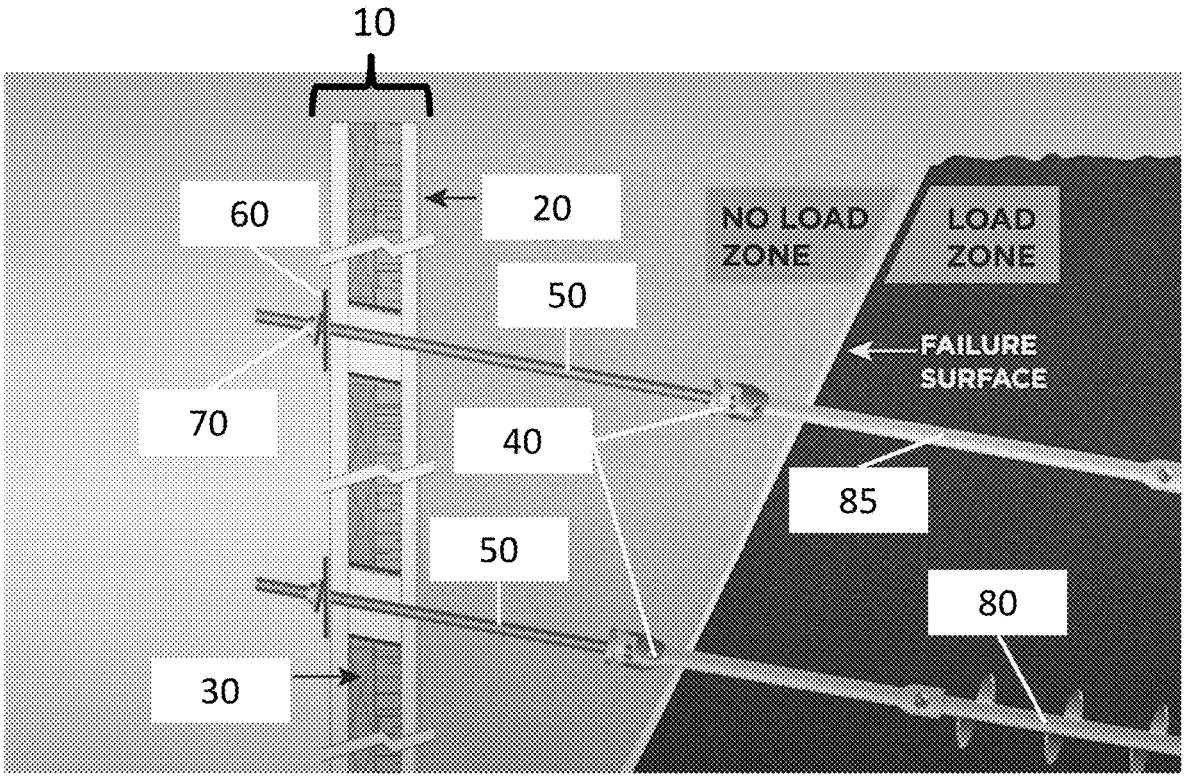
FIGURE 1 (Prior Art)
FIG. 1 illustrates a conventional retention system.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Figure 3:
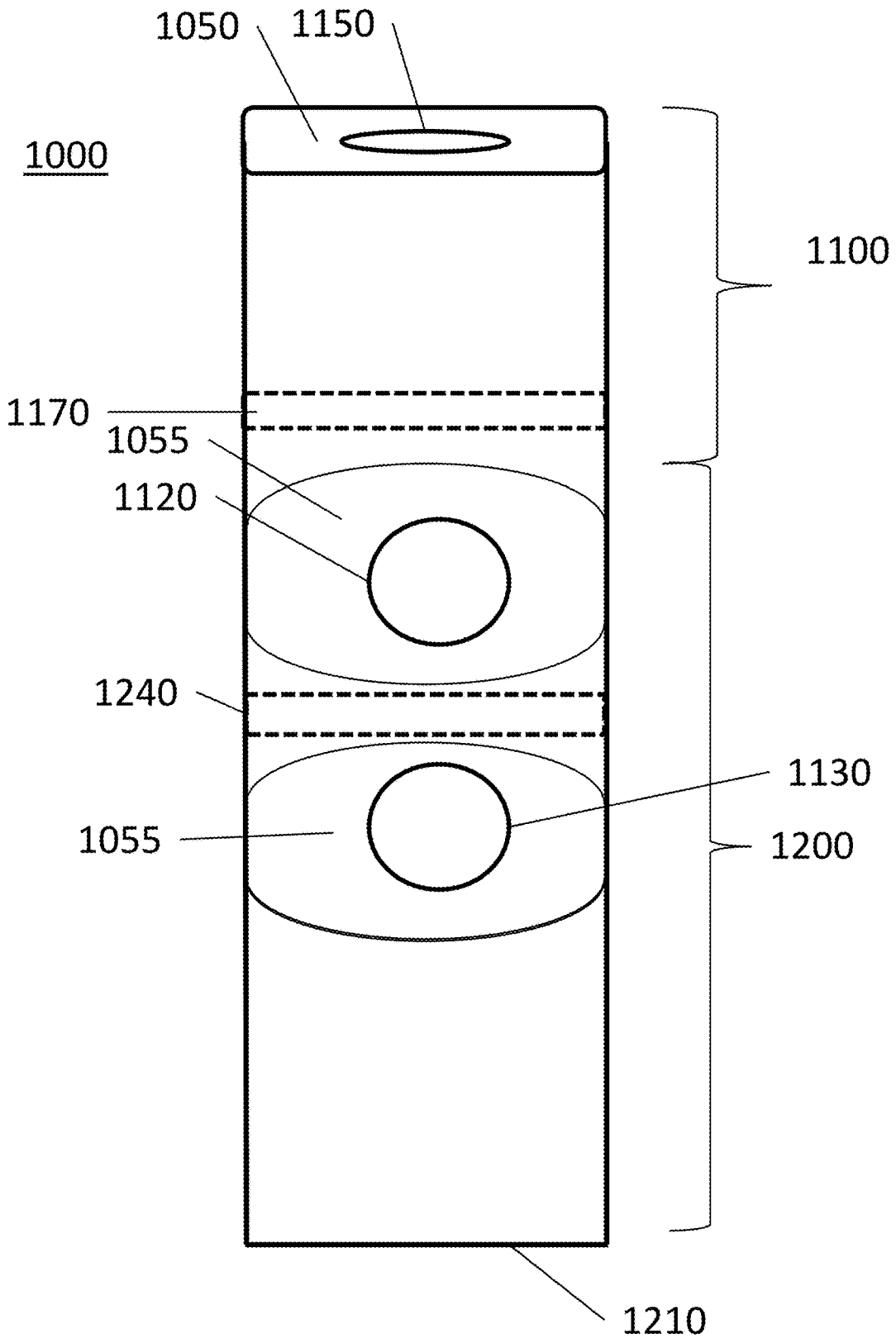
FIG. 3 illustrates a first view of a three-way round pile square pile threaded bar coupler usable for a tieback anchor that includes a pile interface to couple to a circular cross-section type pile and a pile interface to couple to a rectangular/square cross-section type pile.

FIG. 3 illustrates a first view of a three-way round pile square pile threaded bar coupler usable for a tieback anchor that includes a pile interface to couple to a circular cross-section type pile and a pile interface to couple to a rectangular/square cross-section type pile. As illustrated in FIG. 3, the three-way round pile square pile threaded bar coupler usable for a tieback anchor 1000 includes a thread bar interface section 1100 and a pile interface section 1200.

The thread bar interface section 1100 includes a thread bar interface end 1050 having a thread bar opening 1150 for receiving a thread bar (not shown). Additionally, the thread bar interface section 1100 includes a thread bar stop member 1170 located within a thread bar nut chamber (not shown). The thread bar stop member 1170 is operatively tied to the thread bar opening 1150 within the thread bar interface section 1100.

The pile interface section 1200 includes cylindrical pile bolt opening 1120 and cylindrical/square pile bolt opening 1130 for receiving bolts (not shown) to enable the three-way round pile square pile threaded bar coupler usable for a tieback anchor 1000 to be coupled to either a circular cross-section type pile using the combination of the cylindrical pile bolt opening 1120 and the cylindrical/square pile bolt opening 1130 or to a square/rectangular cross section pile using the cylindrical/square pile bolt opening 1130.

Raised areas 1055 may be formed around the cylindrical pile bolt opening 1120 and cylindrical/square pile bolt opening 1130 in the pile interface section 1200 to provide a circumference around pile interface section 1200 to engage an inside of a circular cross-section type pile (not shown).

The pile interface section 1200 also includes a pile interface end 1210 and a square/rectangular cross section pile stop 1240 within the three-way round pile square pile threaded bar coupler usable for a tieback anchor 1000 to enable a fastener opening in a square/rectangular cross section pile to line up with the cylindrical/square pile bolt opening 1130.

Figure 4:
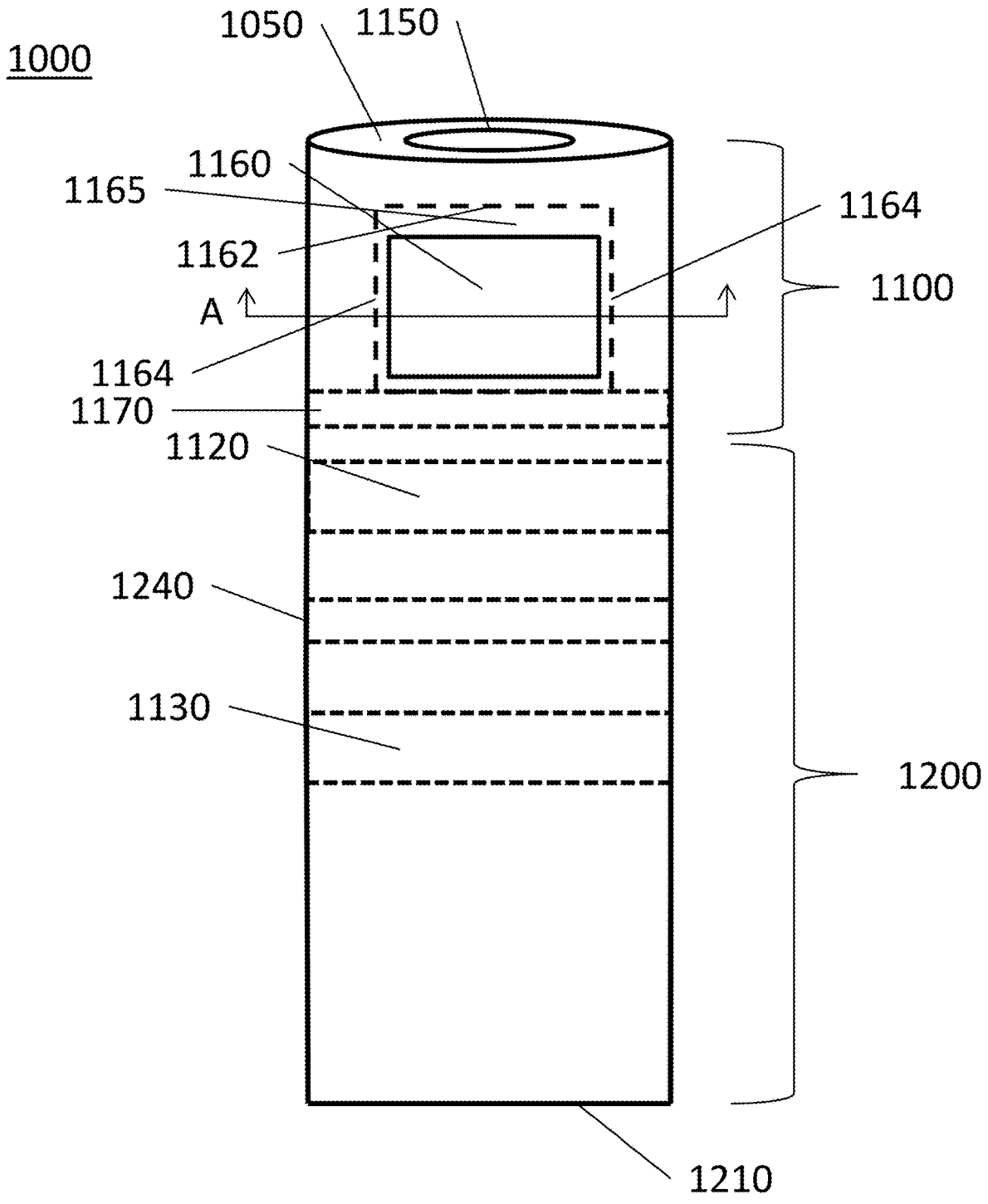
FIG. 4 illustrates a second view of a three-way round pile square pile threaded bar coupler usable for a tieback anchor that includes a pile interface to couple to a circular cross-section type pile and a pile interface to couple to a rectangular/square cross-section type pile.

FIG. 4 illustrates a second view of a three-way round pile square pile threaded bar coupler usable for a tieback anchor 1000 that includes a pile interface to couple to a circular cross-section type pile and a pile interface to couple to a rectangular/square cross-section type pile. As illustrated in FIG. 4, the three-way round pile square pile threaded bar coupler usable for a tieback anchor 1000 includes a thread bar interface section 1100 and a pile interface section 1200.

The thread bar interface section 1100 includes a thread bar interface end 1050 having a thread bar opening 1150 for receiving a thread bar (not shown). The thread bar section 1100 also includes a single thread bar nut opening 1160 for receiving a nut (not shown) that is attached to the thread bar (not shown) within the thread bar nut chamber 1165 located in the three-way round pile square pile threaded bar coupler usable for a tieback anchor 1000. The single thread bar nut opening 1160 is formed by two side opening surfaces, a top opening surface, and a bottom opening surface. Although FIG. 4 illustrates a single thread bar nut opening 1160, an alternative embodiment may include two thread bar nut openings on opposite sides of the thread bar interface section 1100.

Additionally, the thread bar nut chamber 1165 includes a thread bar stop member 1170, making a bottom surface of the thread bar nut chamber 1165; a top surface 1162, located within the thread bar nut chamber 1165; and flat side surfaces 1164, located within the thread bar nut chamber 1165, to keep a thread bar nut (not shown) in place. The flat side surfaces 1164 are co-planar with the side opening surfaces of the thread bar nut opening 1160. Moreover, the flat side surfaces 1164 prevent a thread bar nut (not shown) from rotating when engaging with a thread bar (not shown).

The pile interface section 1200 includes cylindrical pile bolt opening 1120 and cylindrical/square pile bolt opening 1130 for receiving bolts (not shown) to enable the three-way round pile square pile threaded bar coupler usable for a tieback anchor 1000 to be coupled to either a circular cross-section type pile using the combination of the cylindrical pile bolt opening 1120 and the cylindrical/square pile bolt opening 1130 or to a square/rectangular cross section pile using the cylindrical/square pile bolt opening 1130. The pile interface section 1200 also includes a pile interface end 1210.

Additionally, the pile interface section 1200 includes a rectangular/square cross-section type pile stop member 1230 for preventing a rectangular/square cross-section type pile (not shown) from moving further into the three-way round pile square pile threaded bar coupler usable for a tieback anchor 1000. The rectangular/square cross-section type pile stop member 1230 is located between the cylindrical pile bolt opening 1120 and the cylindrical/square pile bolt opening 1130.

Figure 5:
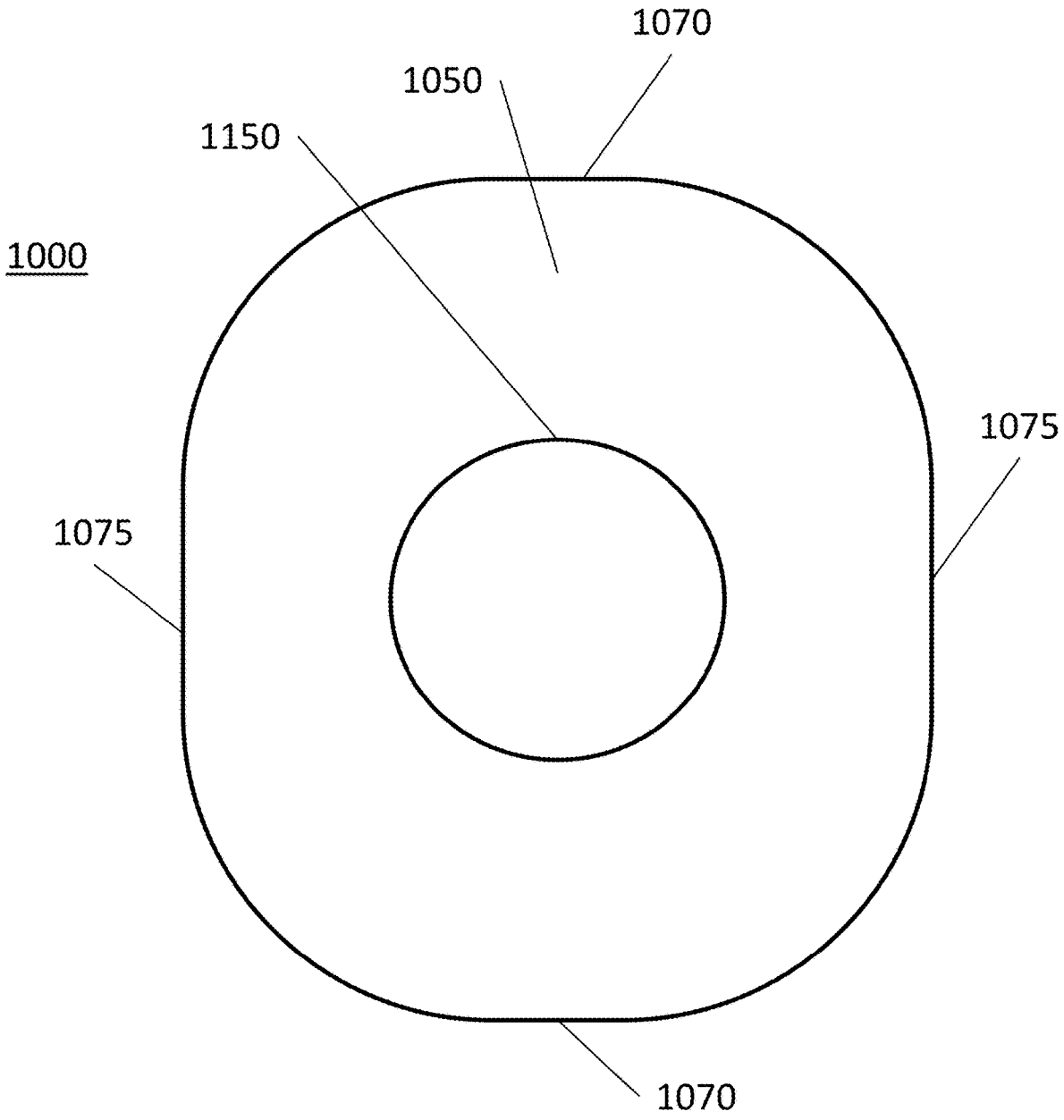
FIG. 5 illustrates a top view of a three-way round pile square pile threaded bar coupler usable for a tieback anchor that includes a pile interface to couple to a circular cross-section type pile and a pile interface to couple to a rectangular/square cross-section type pile.

FIG. 5 illustrates a top view of a three-way round pile square pile threaded bar coupler usable for a tieback anchor that includes a pile interface to couple to a circular cross-section type pile and a pile interface to couple to a rectangular/square cross-section type pile. As noted above, the three-way round pile square pile threaded bar coupler usable for tieback anchor 1000 includes a thread bar interface end 1050 having a thread bar opening 1150 for receiving a thread bar (not shown).

As illustrated in FIG. 5, the thread bar interface end 1050 has two opposing flat surfaces 1070 and two opposing flats surfaces 1175. The two opposing flat surfaces 1070 and two opposing flats surfaces 1175 enable the thread bar interface section to engage a square/rectangular driver, wherein the square/rectangular driver slides over the thread bar interface section and engages the two opposing flat surfaces 1070 and two opposing flats surfaces 1175 to transfer torque from the square/rectangular driver to the three-way round pile square pile threaded bar coupler usable for tieback anchor. The engaged square/rectangular driver allows a pile and a thread bar, both coupled to the three-way round pile square pile threaded bar coupler usable for a tieback anchor, to be driven or further countersunk into the medium.

It is noted that although FIG. 5 shows opposing flat surfaces 1070 and opposing flats surfaces 1175, the thread bar interface end 1050 only requires two opposing flat surfaces to properly engage a square/rectangular driver and enable the transfer of torque from the square/rectangular driver to the three-way round pile square pile threaded bar coupler usable for tieback anchor.

Figure 6:
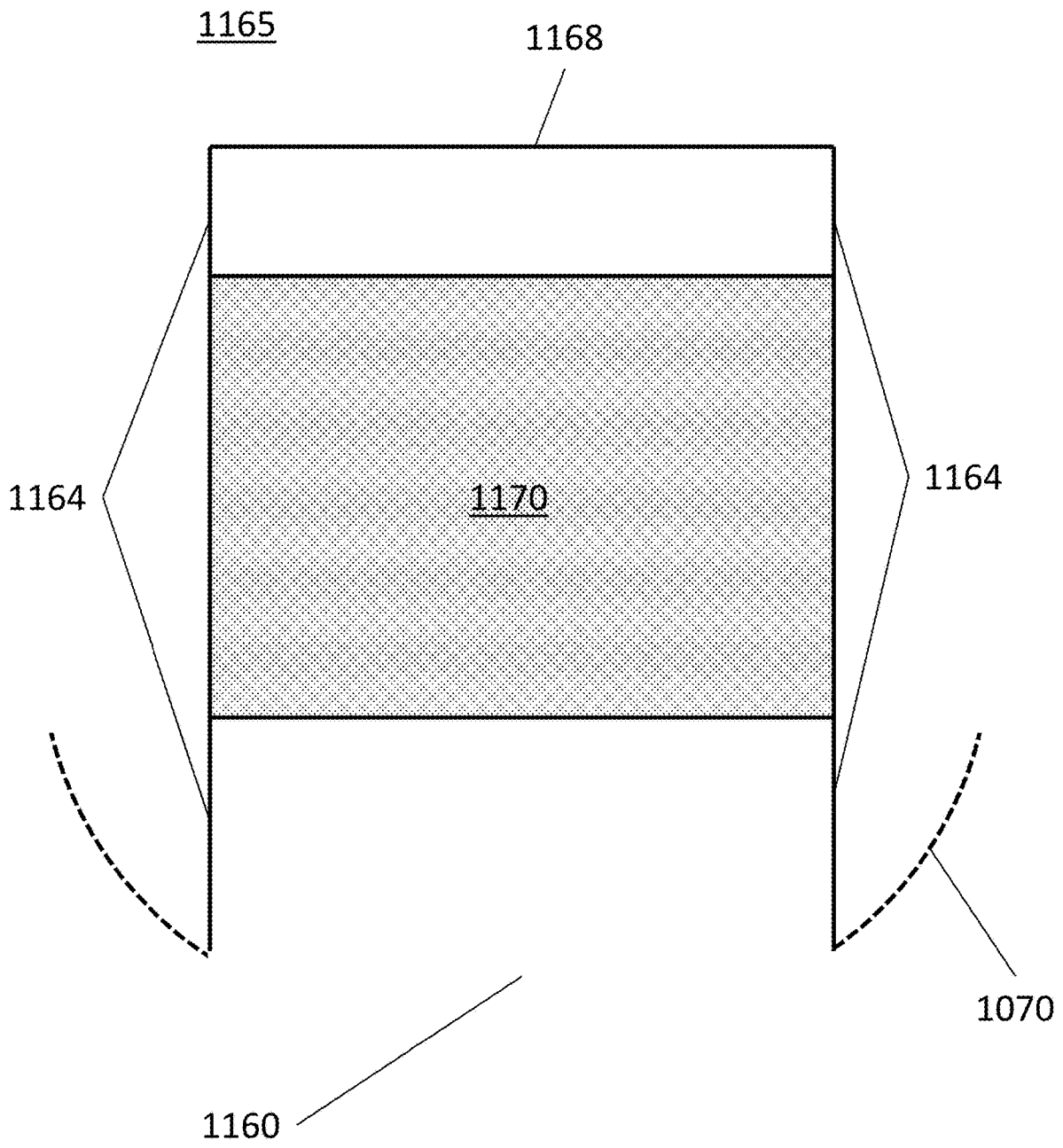
FIG. 6 illustrates a cross-section of the thread bar nut chamber at line A of FIG. 4.

FIG. 6 illustrates a cross-section of the thread bar nut chamber at line A of FIG. 4. As illustrated in FIG. 6, a thread bar nut chamber 1165 includes a thread bar nut opening 1160 for receiving a nut for attaching to the thread bar (not shown) within the thread bar nut chamber 1165 and a thread bar nut stop member 1170, located within the thread bar nut chamber 1165.

The thread bar nut chamber 1165 includes a thread bar nut stop member 1170, located within the thread bar nut chamber 1165; a flat back surface 1168, located within the thread bar nut chamber 1165; and flat side surfaces 1164, located within the thread bar nut chamber 1165, to keep a thread bar nut (not shown) in place. The flat back surface 1168 engages one side of a thread bar nut (not shown), while flat side surfaces 1164 engage two other sides of a thread bar nut (not shown), to keep the thread bar nut (not shown) in place. Moreover, the flat side surfaces 1164 prevent a thread bar nut (not shown) from rotating when engaging with a thread bar (not shown).

Figure 7:
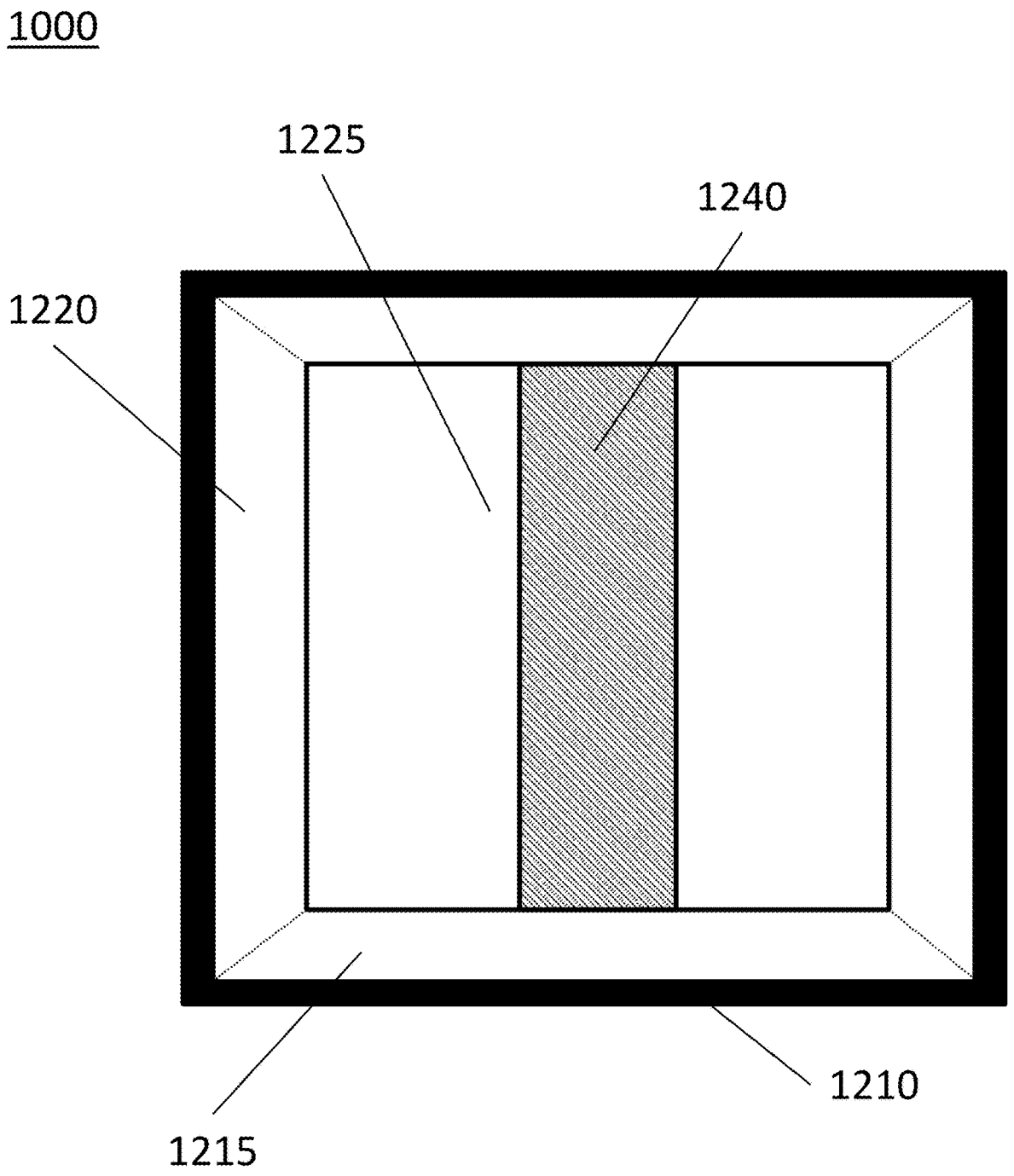
FIG. 7 illustrates a bottom view of a three-way round pile square pile threaded bar coupler usable for a tieback anchor that includes a pile interface to couple to a circular cross-section type pile and a pile interface to couple to a rectangular/square cross-section type pile.

FIG. 7 illustrates a bottom view of a three-way round pile square pile threaded bar coupler usable for a tieback anchor that includes a pile interface to couple to a circular cross-section type pile and a pile interface to couple to a rectangular/square cross-section type pile. As illustrated in FIG. 7, the three-way round pile square pile threaded bar coupler usable for a tieback anchor 1000 includes a pile interface end 1210 having a rectangular/square cross-section type pile opening 1215 for receiving a rectangular/square cross-section type pile (not shown).

The rectangular/square cross-section type pile opening 1215 is formed by sidewalls 1220 that form an inner chamber 1225 within the pile interface section to receive and engage a rectangular/square cross-section type pile (not shown). The rectangular/square cross-section type pile opening 1215 is configured to receive a rectangular/square cross-section type pile (not shown). The sidewalls 1220 of the inner chamber 1225 are configured to engage the outer surfaces of a rectangular/square cross-section type pile (not shown) such that the engagement provides a transfer of torque (rotation) from the three-way round pile square pile threaded bar coupler usable for a tieback anchor 1000 to the engaged (coupled) rectangular/square cross-section type pile.

At a predetermined distance from the pile interface end 1210, within the inner chamber 1225, a rectangular/square cross-section type pile stop member 1230 is located for preventing a rectangular/square cross-section type pile (not shown) from moving further into the three-way round pile square pile threaded bar coupler usable for a tieback anchor 1000. The pile interface end 1210 is located to allow fastener openings in a rectangular/square cross-section type pile (not shown) to align with the cylindrical/square pile bolt opening (not shown).

Figure 2:
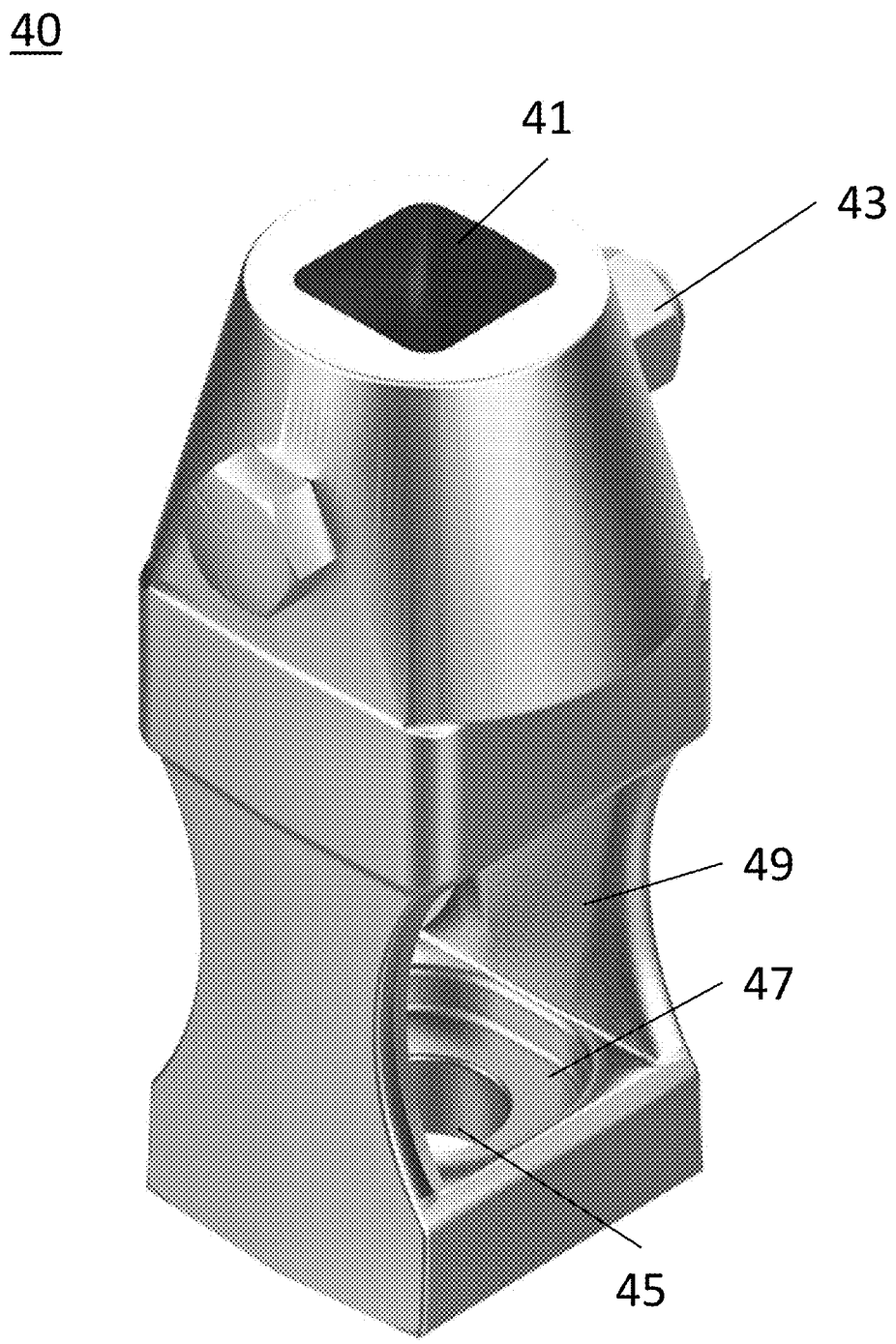
FIGURE 2 (Prior Art)
FIG. 2 illustrates conventional square shaft helical pile adapter for a threaded bar used as a tieback anchor.
Figure 8:
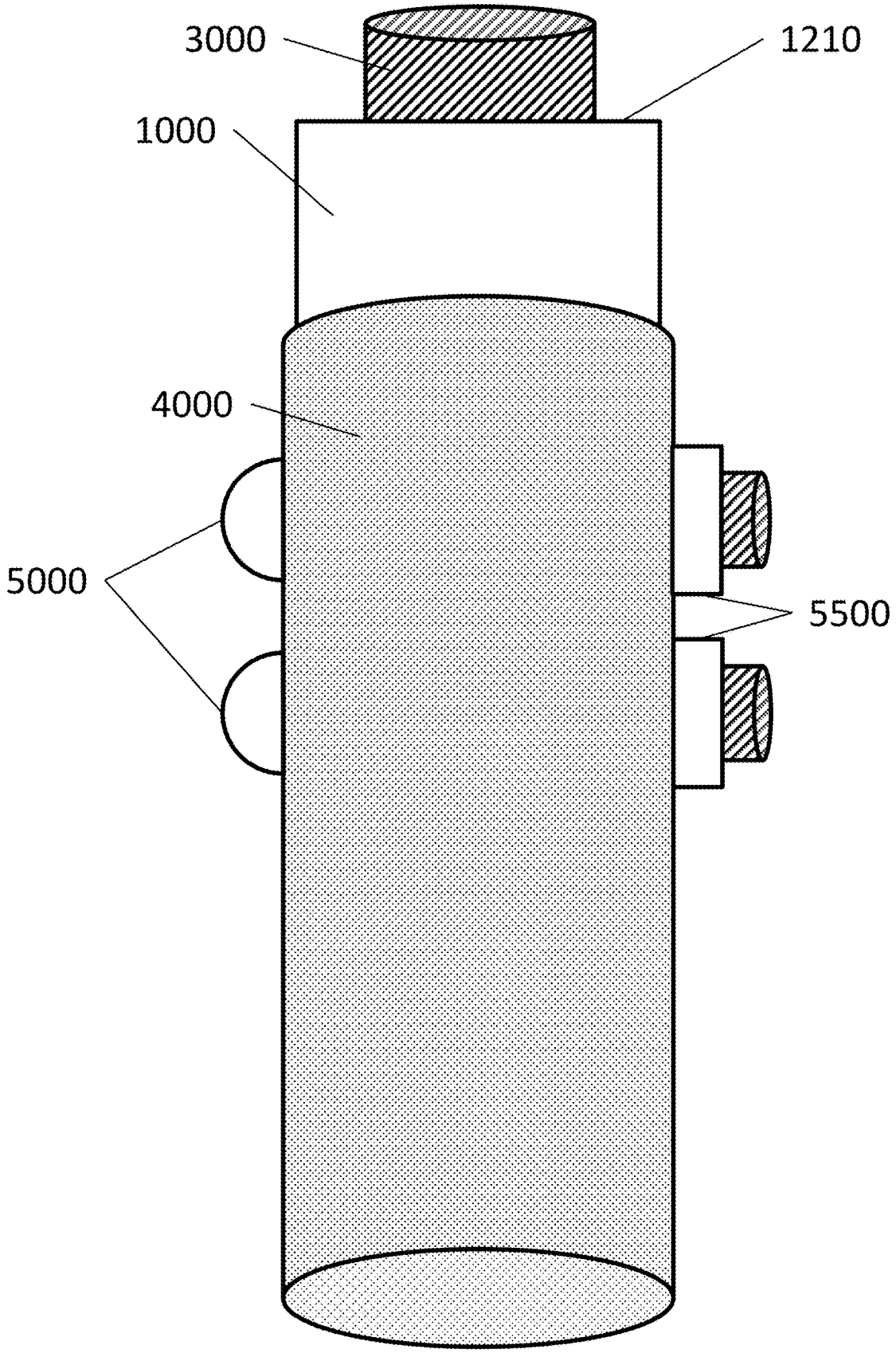
FIG. 8 illustrates the three-way round pile square pile threaded bar coupler usable for a tieback anchor of FIG. 2 coupled to a circular cross-section type pile and a driver.

FIG. 8 illustrates the three-way round pile square pile threaded bar coupler usable for a tieback anchor of FIG. 2 coupled to a circular cross-section type pile and a thread bar. As illustrated In FIG. 8, a three-way round pile square pile threaded bar coupler usable for a tieback anchor 1000 is coupled to a thread bar 3000. The three-way round pile square pile threaded bar coupler usable for a tieback anchor 1000 is also coupled to a circular cross-section type pile 4000.

The circular cross-section type pile 4000 is coupled to the three-way round pile square pile threaded bar coupler usable for a tieback anchor 1000 via bolts 5000 and nuts 5500. The bolts 5000 and nuts 5500 are configured to transfer torque (rotation) from the three-way round pile square pile threaded bar coupler usable for a tieback anchor to the circular cross-section type pile. The bolts 5000 pass through the cylindrical pile bolt opening (not shown) and the cylindrical/square pile bolt opening (not shown).

The inner surface of the circular cross-section type pile 4000 engages the raised areas (not shown) formed around the cylindrical pile bolt opening (not shown) and cylindrical/square pile bolt opening (not shown) in the pile interface section.

Figure 9:
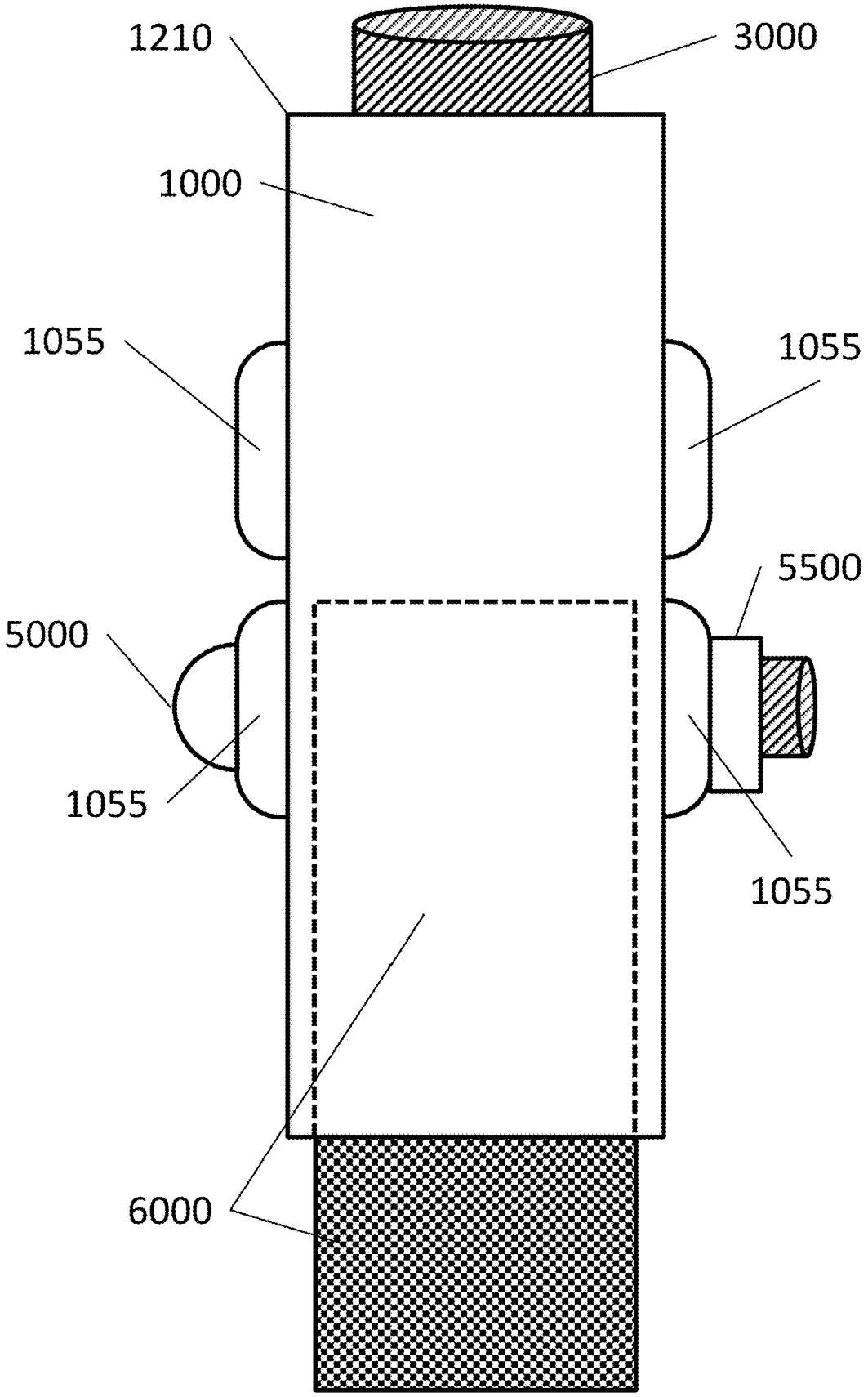
FIG. 9 illustrates the three-way round pile square pile threaded bar coupler usable for a tieback anchor of FIG. 2 coupled to a rectangular/square cross-section type pile and a driver.

FIG. 9 illustrates the three-way round pile square pile threaded bar coupler usable for a tieback anchor of FIG. 2 coupled to a rectangular/square cross-section type pile and a thread bar 3000. As illustrated In FIG. 9, a three-way round pile square pile threaded bar coupler usable for a tieback anchor 1000 is coupled to a thread bar 3000. The three-way round pile square pile threaded bar coupler usable for a tieback anchor 1000 is also coupled to a rectangular/square cross-section type pile 6000. The rectangular/square cross-section type pile 6000 is coupled to the three-way round pile square pile threaded bar coupler usable for a tieback anchor 1000 via the rectangular/square cross-section type pile opening (not shown).

The rectangular/square cross-section type pile opening (not shown) and inner chamber (not shown) are configured to engage the outer surface of a rectangular/square cross-section type pile such the engagement provide a transfer of torque (rotation) from the three-way round pile square pile threaded bar coupler usable for a tieback anchor to the rectangular/square cross-section type pile.

As illustrated in FIG. 9, the pile interface section includes raised areas 1055 formed around the pile bolts openings (not shown) of the pile interface section provide a circumference around pile interface section to engage an inside of a circular cross-section type pile (not shown).

A bolt 5000 and nut 5500 may be used to additionally secure the rectangular/square cross-section type pile 6000 to the three-way round pile square pile threaded bar coupler usable for a tieback anchor. The bolt 5000 passes through the cylindrical/square pile bolt opening (not shown).

Figure 10:
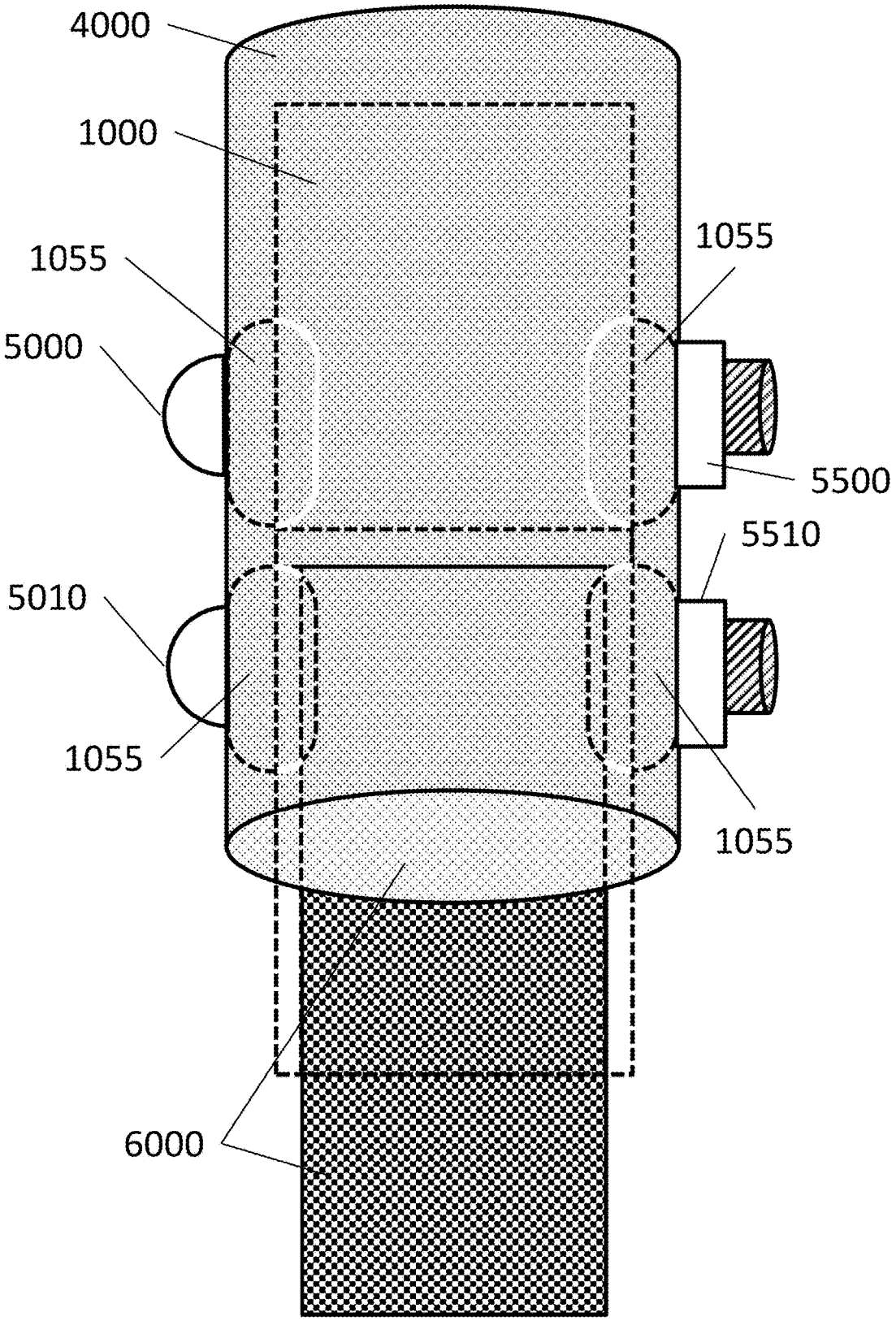
FIG. 10 illustrates the three-way round pile square pile threaded bar coupler usable for a tieback anchor of FIG. 2 coupled to a rectangular/square cross-section type pile and a circular cross-section type pile.

FIG. 10 illustrates the three-way round pile square pile threaded bar coupler usable for a tieback anchor of FIG. 2 coupled to a rectangular/square cross-section type pile 6000 and a circular cross-section type pile 4000. As illustrated In FIG. 10, a three-way round pile square pile threaded bar coupler usable for a tieback anchor 1000 is coupled to a circular cross-section type pile 4000.

The three-way round pile square pile threaded bar coupler usable for a tieback anchor 1000 is also coupled to a rectangular/square cross-section type pile 6000. The rectangular/square cross-section type pile 6000 is coupled to the three-way round pile square pile threaded bar coupler usable for a tieback anchor 1000 via the rectangular/square cross-section type pile opening (not shown).

The rectangular/square cross-section type pile opening (not shown) and inner chamber (not shown) are configured to engage the outer surface of a rectangular/square cross-section type pile such the engagement provide a transfer of torque (rotation) from the three-way round pile square pile threaded bar coupler usable for a tieback anchor to the rectangular/square cross-section type pile.

As illustrated in FIG. 10, the pile interface section includes raised areas 1055 formed around the pile bolts openings (not shown) of the pile interface section provide a circumference around pile interface section to engage an inside of a circular cross-section type pile (not shown).

A bolt 5000 and nut 5500 are used to secure the circular cross-section type pile 4000 to the three-way round pile square pile threaded bar coupler usable for a tieback anchor. The bolt 5000 passes through the circular cross-section type pile 4000 and a cylindrical/square pile bolt opening (not shown).

A bolt 5010 and nut 5510 are used to secure both the circular cross-section type pile 4000 and the rectangular/square cross-section type pile 6000 to the three-way round pile square pile threaded bar coupler usable for a tieback anchor. In this embodiment, the bolt 5010 passes through both the circular cross-section type pile 4000 and the rectangular/square cross-section type pile 6000. Thus, the bolt 5010 passes through both the circular cross-section type pile 4000 and the rectangular/square cross-section type pile 6000 and a cylindrical/square pile bolt opening (not shown).

Figure 11:
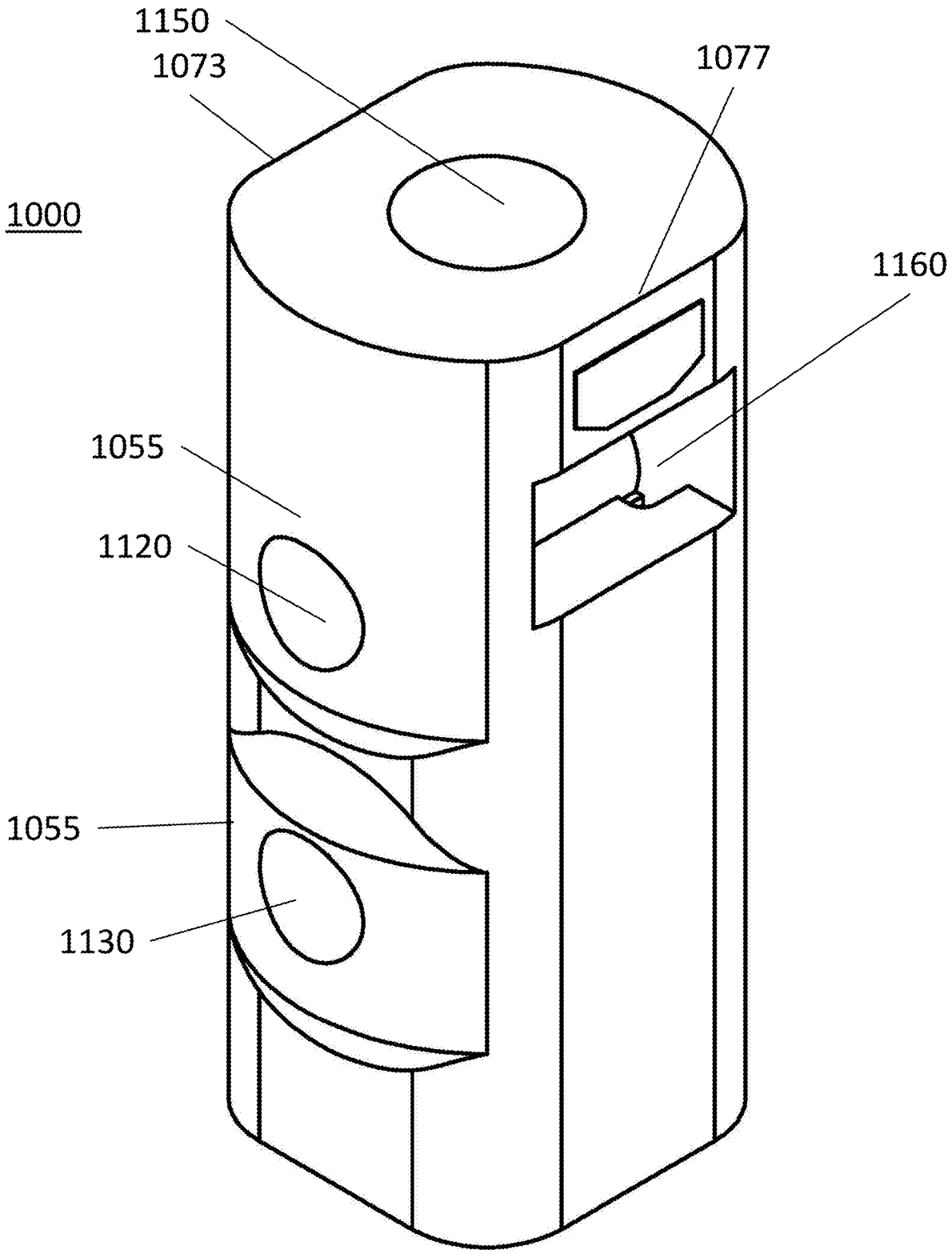
FIG. 11 illustrates a first side view of the three-way round pile square pile threaded bar coupler usable for a tieback anchor.

FIG. 11 illustrates a first side view of the three-way round pile square pile threaded bar coupler usable for a tieback anchor. As illustrated in FIG. 11, the three-way round pile square pile threaded bar coupler usable for a tieback anchor 1000 includes a thread bar interface section and a pile interface section.

The thread bar interface section includes a thread bar interface end having a thread bar opening 1150 for receiving a thread bar (not shown).

The pile interface section includes cylindrical pile bolt opening 1120 and cylindrical/square pile bolt opening 1130 for receiving bolts (not shown) to enable the three-way round pile square pile threaded bar coupler usable for a tieback anchor 1000 to be coupled to either a circular cross-section type pile using the combination of the cylindrical pile bolt opening 1120 and the cylindrical/square pile bolt opening 1130 or to a square/rectangular cross section pile using the cylindrical/square pile bolt opening 1130.

Raised areas 1055 are formed around the cylindrical pile bolt opening 1120 and cylindrical/square pile bolt opening 1130 in the pile interface section to provide a circumference around pile interface section to engage an inside of a circular cross-section type pile (not shown).

The pile interface section also includes a pile interface end and a square/rectangular cross section pile stop within the three-way round pile square pile threaded bar coupler usable for a tieback anchor 1000 to enable a fastener opening in a square/rectangular cross section pile to line up with the cylindrical/square pile bolt opening 1130.

The thread bar interface section includes a single thread bar nut opening 1160 for receiving a nut (not shown) that is attached to the thread bar (not shown) within the thread bar nut chamber 1165 located on a flat surface 1077 of the three-way round pile square pile threaded bar coupler usable for a tieback anchor 1000, opposite a flat surface 1073 of the three-way round pile square pile threaded bar coupler usable for a tieback anchor 1000. The single thread bar nut opening 1160 is formed by two side opening surfaces, a top opening surface, and a bottom opening surface.

The two opposing flat surfaces 1077 and 1073 enable the thread bar interface section to engage a square/rectangular driver, wherein the square/rectangular driver slides over the thread bar interface section and engages the two opposing flat surfaces 1077 and 1073 to transfer torque from the square/rectangular driver to the three-way round pile square pile threaded bar coupler usable for tieback anchor.

The engaged square/rectangular driver allows a pile and a thread bar, both coupled to the three-way round pile square pile threaded bar coupler usable for a tieback anchor, to be driven or further countersunk into the medium.

Figure 12:
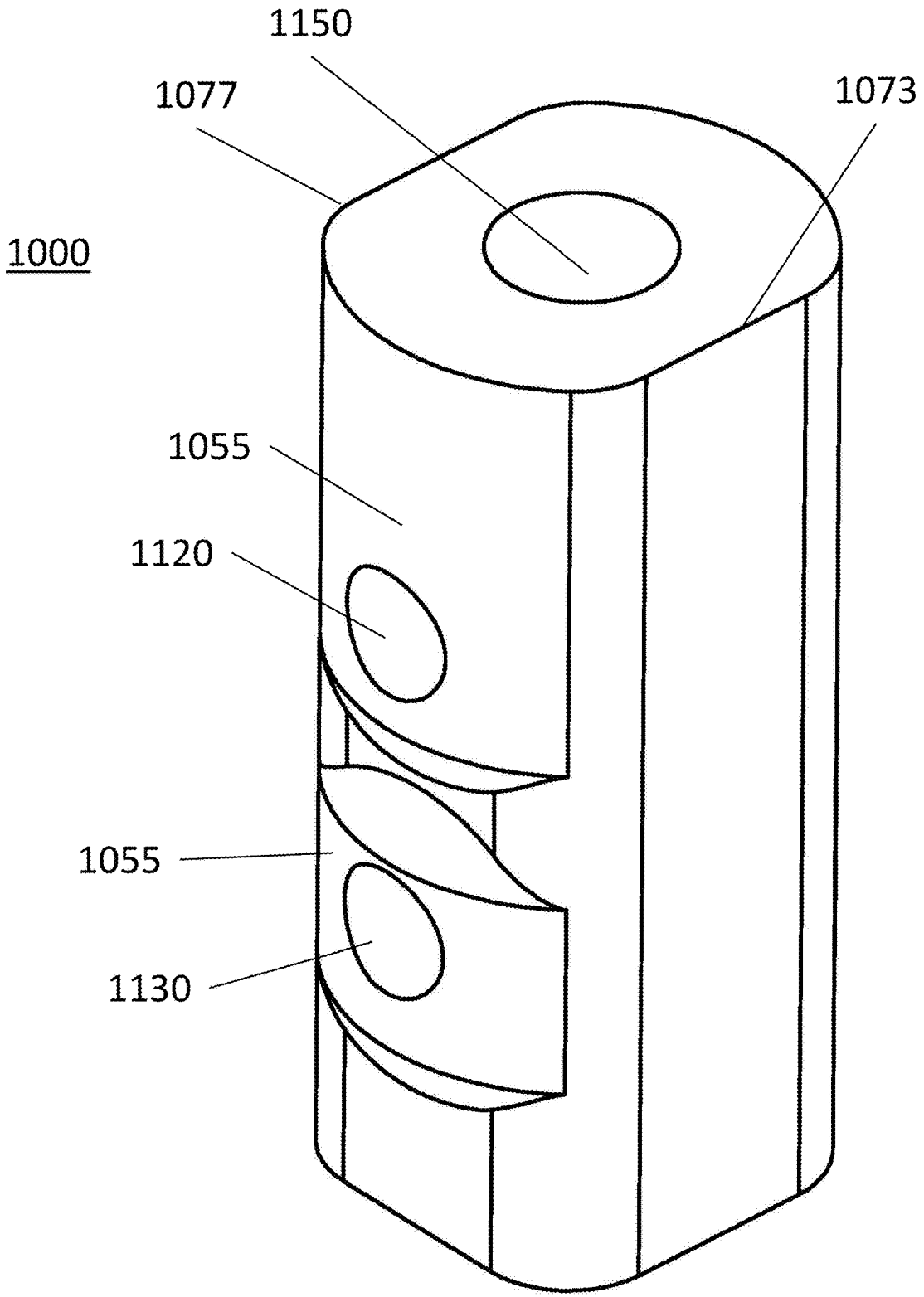
FIG. 12 illustrates a second view of the three-way round pile square pile threaded bar coupler usable for a tieback anchor.

FIG. 12 illustrates a second view of the three-way round pile square pile threaded bar coupler usable for a tieback anchor. As illustrated in FIG. 12, the three-way round pile square pile threaded bar coupler usable for a tieback anchor 1000 includes a thread bar interface section and a pile interface section.

The thread bar interface section includes a thread bar interface end having a thread bar opening 1150 for receiving a thread bar (not shown).

The pile interface section includes cylindrical pile bolt opening 1120 and cylindrical/square pile bolt opening 1130 for receiving bolts (not shown) to enable the three-way round pile square pile threaded bar coupler usable for a tieback anchor 1000 to be coupled to either a circular cross-section type pile using the combination of the cylindrical pile bolt opening 1120 and the cylindrical/square pile bolt opening 1130 or to a square/rectangular cross section pile using the cylindrical/square pile bolt opening 1130.

Raised areas 1055 are formed around the cylindrical pile bolt opening 1120 and cylindrical/square pile bolt opening 1130 in the pile interface section to provide a circumference around pile interface section to engage an inside of a circular cross-section type pile (not shown).

The pile interface section also includes a pile interface end and a square/rectangular cross section pile stop within the three-way round pile square pile threaded bar coupler usable for a tieback anchor 1000 to enable a fastener opening in a square/rectangular cross section pile to line up with the cylindrical/square pile bolt opening 1130.

The thread bar interface section includes a flat surface 1077 and an opposing (opposite) flat surface 1073. The two opposing flat surfaces 1077 and 1073 enable the thread bar interface section to engage a square/rectangular driver, wherein the square/rectangular driver slides over the thread bar interface section and engages the two opposing flat surfaces 1077 and 1073 to transfer torque from the square/rectangular driver to the three-way round pile square pile threaded bar coupler usable for tieback anchor. The engaged square/rectangular driver allows a pile and a thread bar, both coupled to the three-way round pile square pile threaded bar coupler usable for a tieback anchor, to be driven or further countersunk into the medium.

A three-way round pile square pile threaded bar coupler includes a thread bar interface section; and a pile interface section; the pile interface section including a first pile interface configured to couple to a round cross-section type pile and a second pile interface configured to couple to a four-sided cross section type pile; the thread bar interface section including a thread bar interface end having a thread bar opening configured to receive a thread bar and a thread bar nut chamber configured to prevent a thread bar nut from rotating; the pile interface section including first pile openings configured to receive a bolt associated with a round cross-section type pile; the pile interface section including second pile openings configured to receive a bolt associated with a round cross-section type pile, the second pile openings being configured to receive a bolt associated with a four-sided cross section type pile; the pile interface section including a four-sided cross section type pile opening and inner four-sided cross section type pile chamber; the inner four-sided cross section type pile chamber including a four-sided cross section type pile stop member configured to enable a fastener opening of a four-sided cross section type pile to line up with the second pile opening.

The four-sided cross section type pile stop member may be located between the first pile openings and the second pile openings.

The thread bar interface section may include two opposing exterior flat surfaces configured to engage a four-sided driver and to transfer torque from a four-sided driver to the three-way round pile square pile threaded bar coupler.

The thread bar nut chamber may include a thread bar stop member; a top surface; a first surface, and a second surface; the thread bar interface section including a thread bar nut opening configured to receive a thread bar nut into the thread bar nut chamber; the first and second surfaces configured to prevent a thread bar nut from rotating.

The pile interface section may include raised areas around the first plie openings and the second pile openings; the raised areas configured to engage an inside of a round cross-section type pile.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the description above.

What is claimed is:

1. A three-way round pile square pile threaded bar coupler, comprising:

a thread bar interface section; and a pile interface section;

said pile interface section including a first pile interface configured to couple to a round cross-section type pile and a second pile interface configured to couple to a four-sided cross section type pile;

said thread bar interface section including a thread bar interface end having a thread bar opening configured to receive a thread bar and a thread bar nut chamber configured to prevent a thread bar nut from rotating;

said pile interface section including first pile openings configured to receive a bolt associated with a round cross-section type pile;

said pile interface section including second pile openings configured to receive a bolt associated with a round cross-section type pile, said second pile openings being configured to receive a bolt associated with a four-sided cross section type pile;

said pile interface section including a four-sided cross section type pile opening and inner four-sided cross section type pile chamber;

said inner four-sided cross section type pile chamber including a four-sided cross section type pile stop member configured to enable a fastener opening of a four-sided cross section type pile to line up with said second pile opening.

2. The coupler, as claimed in claim 1, wherein said four-sided cross section type pile stop member is located between said first pile openings and said second pile openings.

3. The coupler, as claimed in claim 1, wherein said thread bar interface section includes two opposing exterior flat surfaces configured to engage a four-sided driver and to transfer torque from a four-sided driver to the three-way round pile square pile threaded bar coupler.

4. The coupler, as claimed in claim 2, wherein said thread bar interface section includes two opposing exterior flat surfaces configured to engage a four-sided driver and to transfer torque from a four-sided driver to the three-way round pile square pile threaded bar coupler.

5. The coupler, as claimed in claim 1, wherein said thread bar nut chamber includes a thread bar stop member; a top surface; a first surface, and a second surface;

said thread bar interface section including a thread bar nut opening configured to receive a thread bar nut into said thread bar nut chamber;

said first and second surfaces configured to prevent a thread bar nut from rotating.

6. The coupler, as claimed in claim 2, wherein said thread bar nut chamber includes a thread bar stop member; a top surface; a first surface, and a second surface;

said thread bar interface section including a thread bar nut opening configured to receive a thread bar nut into said thread bar nut chamber;

said first and second surfaces configured to prevent a thread bar nut from rotating.

7. The coupler, as claimed in claim 3, wherein said thread bar nut chamber includes a thread bar stop member; a top surface; a first surface, and a second surface;

said thread bar interface section including a thread bar nut opening configured to receive a thread bar nut into said thread bar nut chamber;

said first and second surfaces configured to prevent a thread bar nut from rotating.

8. The coupler, as claimed in claim 1, wherein said pile interface section includes raised areas around said first plie openings and said second pile openings;

said raised areas configured to engage an inside of a round cross-section type pile.

9. The coupler, as claimed in claim 2, wherein said pile interface section includes raised areas around said first plie openings and said second pile openings;

said raised areas configured to engage an inside of a round cross-section type pile.

10. The coupler, as claimed in claim 3, wherein said pile interface section includes raised areas around said first plie openings and said second pile openings;

said raised areas configured to engage an inside of a round cross-section type pile.

11. The coupler, as claimed in claim 5, wherein said pile interface section includes raised areas around said first plie openings and said second pile openings;

said raised areas configured to engage an inside of a round cross-section type pile.

* * * * *